US005152959A

United States Patent [19]

Scorey

[11] Patent Number: 5,152,959

[45] Date of Patent: Oct. 6, 1992

[54] SINTERLESS POWDER METALLURGY PROCESS FOR MANUFACTURING COMPOSITE COPPER STRIP

[75] Inventor: Clive R. Scorey, Cheshire, Conn.

[73] Assignee: AMETEK Speciality Metal Products Division, Wallingford, Conn.

[21] Appl. No.: 719,413

[22] Filed: Jun. 24, 1991

[51] Int. Cl.[5] ..... C22C 32/00; B22F 1/00

[52] U.S. Cl. ..... 419/66; 419/10; 419/19; 419/22; 419/30; 419/35; 419/44; 419/61; 419/64; 419/69

[58] Field of Search ..... 419/6, 30, 26, 31, 35, 419/38, 43, 50, 60, 66, 10, 19, 22, 44, 61, 64, 69

[56] References Cited

U.S. PATENT DOCUMENTS 4,299,629 11/1981 Haack ..... 75/251
4,594,217 6/1986 Samal ..... 419/3
4,604,259 8/1986 Whitman ..... 75/247
4,752,334 6/1988 Nadkarni et al. ..... 75/235
4,885,214 12/1989 Trenkler et al. ..... 428/614
4,933,008 6/1990 Fujiki et al. ..... 75/244

*Primary Examiner*—Brooks H. Hunt
*Assistant Examiner*—Daniel Jenkins
*Attorney, Agent, or Firm*—Bachman & LaPointe

[57] ABSTRACT

The present invention relates to a process for forming a composite strip material without any sintering step. The process includes blending a powdered high conductivity material such as powdered copper with a powdered low thermal expansion phase material such as a nickel-iron alloy, compacting the powders to form a green composite strip, heating the green strip to a hot rolling temperature and hot rolling the heated strip to a desired gauge. The heated strip is reduced less than about 45% to minimize the deformation of the low thermal expansion phase particles.

16 Claims, No Drawings

SINTERLESS POWDER METALLURGY PROCESS FOR MANUFACTURING COMPOSITE COPPER STRIP

BACKGROUND OF THE INVENTION

The present invention relates to a process for making a fully dense composite strip from a blend of copper and nickel-iron alloy powders which substantially avoids the problems associated with interdiffusion between the component powders and which maximizes through-thickness thermal conductivity.

A copper matrix composite with an INVAR (36% Ni -Balance Fe) reinforcing phase offers the potential of high thermal conductivity with low thermal expansion. While copper-clad INVAR offers low in-plane thermal expansion, it has very poor through-thickness thermal conductivity. It is very desirable therefore to fabricate a copper-INVAR composite strip by powder metallurgy since a continuous copper path through the strip thickness gives much improved thermal conductivity in this direction.

One prior attempt to form such a composite strip is described in U.S. Pat. No. 4,158,719 to Frantz. The Frantz patent teaches the blending of a highly thermal conductive powder such as copper with a controlled expansion alloy powder, compacting the blended powders, sintering at high temperature and cold rolling to produce a final product. The sintering step in the Frantz process is carried out at a temperature of 982° C. or higher. It has been discovered that sintering at such high temperatures causes excessive interdiffusion between the composite components which dramatically reduces the thermal and electrical conductivity of the copper matrix. Attempts have been made to minimize this problem by using as low a sinter temperature and as low a sinter time as possible. One such attempt is described in U.S. Pat. No. 4,836,979 to Bell et al.

The Bell et al. patent also relates to a process for producing a high conductivity, low thermal coefficient of expansion composite material. The process is as follows. A powder of copper, silver or copper-silver alloy and powdered nickel-iron alloy are compacted to form a green strip, sintered for at least about 2 minutes in the temperature range of 550° C. to 750° C. and rolled at a temperature in that range to at least about 95% theoretical density. The iron-nickel alloy powder used in this process is preferably made up of particles having a copper, silver or copper-silver alloy deposit on their surfaces. This deposit is formed from a liquid containing the material to be deposited. For example, deposition of the desired material is done by electrode position from an aqueous solution, chemical replacement plating, chemical reduction plating, or deposition from organic solutions such as alcohols and glycols.

The need to sinter the materials still remains a problematic step. While sintering at low temperatures reduces the interdiffusion problem, it does not eliminate it.

SUMMARY OF THE INVENTION

It is therefore an object of the present invention to provide a process for fabricating a high thermal conductivity, low thermal expansion composite material without any sintering step.

It is a further object of the present invention to provide a process as above for fabricating a composite material which substantially avoids problems associated with interdiffusion between component powders.

It is yet a further object of the present invention to provide a process as above for fabricating a composite material which maximizes through-thickness thermal conductivity.

Still further objects and advantages will become more apparent from the following description.

The foregoing objects are achieved by the following process of the present invention which broadly comprises blending a powdered high conductivity material such as powdered copper or a powdered copper alloy with a powdered low thermal expansion material such as a powdered nickel-iron alloy and compacting the blended powdered materials into a green strip having a desired thickness. Thereafter, the green strip is passed through a furnace where it is heated to a hot rolling temperature in as short a time as possible, preferably much less than about 2 minutes. The heated strip may then be directly hot rolled to essentially full density and quenched.

It has been found that the through-thickness thermal conductivity of the composite strip material can be improved by initially coating the low thermal expansion material particles with a layer of the high conductivity matrix component and/or by limiting the total reduction in thickness given to the green strip by less than about 45%.

The process of the present invention has been found to be particularly advantageous in forming copper-INVAR (36% nickel - balance iron) composite strip material. As used herein, the word "strip" also encompasses sheet, wire and rod materials.

DETAILED DESCRIPTION

The process of the present invention is used to form a composite strip material having a high conductivity matrix component and a low thermal expansion material component. The high conductivity matrix component is preferably copper or copper alloy, while the low thermal expansion component is a nickel-iron alloy such as INVAR. INVAR is an alloy containing about 36% nickel, balance essentially iron together with the usual amounts of impurities and incidental elements.

The composite strip is formed by first blending the high conductivity matrix component in powdered form with the low thermal expansion metal component also in powdered form in the proportions needed to achieve a desired composite material. The various component powders can be made by standard techniques such as by precipitation, grinding or atomizing or can be purchased from commercial sources.

The low thermal expansion metal component is preferably a nickel-iron alloy with a nickel content in the range of about 30 wt.% to about 60 wt.%, preferably from about 30 wt.% to about 42 wt.%, and the balance essentially iron together with usual amounts of impurities and incidental elements. INVAR, a nickel-iron alloy containing about 36% nickel, balance essentially iron together with usual amounts of impurities and incidental elements, is a particularly preferred material for the low thermal expansion metal component. Other materials suitable for use as the low thermal expansion metal component include a nickel-iron alloy sold under the trademark SUPER-INVAR and a nickel-iron alloy having a composition of about 31% nickel, 15% cobalt and balance essentially iron with the usual amounts of impurities and incidental elements The low thermal expansion metal component particles should have a particle size in the range of from about 20 microns to about 200 microns, preferably from about 50 microns to about 100 microns, and an aspect ratio in the range of from about 1.0 to about 4.0, preferably from about 1.0 to about 2.0. As used herein, the term "aspect ratio" may be defined as the ratio of the in-plane dimension to the through plane dimension Below about 20 microns, the particles cannot be easily coated. Above about 200 microns, the particles are so large they become a significant fraction of strip thickness - an undesirable result. Ideally, the low thermal expansion metal component particles include a mix of large and small particles so as to improve packing density. In a particularly preferred embodiment, the particles are substantially spherical, i.e., they have an aspect ratio approximately equal to 1.0.

If desired, the low thermal expansion material particles may be coated with a layer of the matrix component prior to blending the two powders. It has been found that such a coating helps improve the through-thickness conductivity of the final composite product. The coating of the low thermal expansion metal particles may be accomplished by blending the low thermal expansion phase material in powder form with an oxide of the matrix material. When the low conductivity material is a nickel-iron alloy and the matrix component is copper, from about 31 wt.% to about 83 wt.%, preferably from about 42 wt.% to about 67 wt.%, of said nickel-iron alloy is blended with from about 69 wt.% to about 17 wt.%, preferably from about 58 wt.% to about 33 wt.%, cuprous oxide powder having a particle size in the range of from about 0.1 microns to about 10 microns, preferably from about 1 micron to about 5 microns. A wetting agent such as pine oil or glycerine, may be added to the mixture in an amount as low as about 0.2 wt.% and preferably in a range of from about 0.5 wt.% to about 5.0 wt.%. The wetting agent causes the oxide particles to adhere to the surface of the low thermal expansion phase particles.

The powdered low thermal expansion material and the powdered oxide material are intimately blended. Any suitable means known in the art such as a twin shell rotating blender which typically has a blending time in the range of from about 1.0 minute to about 6.0 minutes may be used to blend the two powders together. Thereafter, the blended powders are heated in a reducing atmosphere. For a nickel-iron alloy-cuprous oxide blend, the powder may be heated in a hydrogen-containing atmosphere at a temperature from about 425° C. to about 625° C., preferably from about 480° C. to about 565° C., for a time period in the range of from about 5 minutes to about 30 minutes. The resulting cake of low expansion phase material with the reduced oxide material may be ground into a powder using any suitable means known in the art such as a hammer mill. The powdered particles comprise discrete particles of the low expansion phase material coated with the reduced matrix material.

The uncoated or coated particles are then blended with a quantity of the matrix material sufficient to yield a composite having a desired composition. Where the matrix material is copper or a copper alloy, from about 31 wt.% to about 85 wt.%, preferably from about 42 wt.% to about 70 wt.% of, the low expansion phase material particles, either in coated or uncoated form, is blended with from about 69 wt.% to about 15 wt.%, preferably from about 58 wt.% to about 30 wt.%, of copper or copper alloy in powder form so as to form a composite having from about 35 vol.% to about 86 vol.% of the low expansion phase material and the balance essentially the high thermal conductivity material. Preferably, the powdered copper or copper alloy is made up of particles having a size in the range of from about 10 $\mu$ to about 200 $\mu$, preferably from about 40 $\mu$ to about 100 $\mu$.

The blended particles are then compacted into a green strip material having the aforesaid composition. In a preferred embodiment, the green strip consists of from about 48 vol.% to about 72 vol.% of said low thermal expansion phase material and the balance essentially copper, if one assumes 100% density, i.e., no volume percent voids in addition to copper and INVAR. If one needs to make a green strip density correction, i.e., not 100% dense, then the green strip consists of from about 37 vol.% to about 66 vol.% of the low thermal expansion phase material and the balance essentially copper and voids.

The blended powders may be compacted into said green strip using any suitable compacting technique known in the art. For example, the blended powders may be fed, preferably in a continuous manner, into a rolling mill where the powders are compacted to cause a mechanical bond between adjacent particles. The compaction loads and roll speeds may be selected so as to insure a strip density of the green strip which is about 70 to 95 percent of the theoretical density of the strip, and a strip thickness of between about 0.025 inch and 0.25 inch.

The green strip may have any desired thickness and any desired density. For example, the initial strip thickness may be in the range of from about 0.050" to about 0.075" and the strip density may be 88% theoretical density.

The green strip is processed by directly hot rolling it to full density without any sintering step. This is done by heating the strip to a hot rolling temperature in the range of from about 525° C. to about 700° C. in as short a time as possible, preferably less that about 2 minutes and most preferably in a time range of from about 15 seconds to about 60 seconds. Heating of the green strip may be performed by passing the strip continuously through a furnace set at a temperature in the range of from about 525° C. to about 1050° C., preferably from about 650° C. to about 900° C., with a hydrogen containing atmosphere. Desirably, the strip spends no more time than a few seconds i.e., from one to ten seconds at the hot rolling temperature which does not exceed 700° C.

It should be recognized that there are a wide variety of furnaces which can be used to heat the strip to the desired temperature. These include electric resistance and induction heating systems which are advantageous to rapid heating.

Hot rolling occurs as the strip leaves the furnace using any suitable rolling device known in the art. The total reduction taken by hot rolling is preferably less than about 45% of the initial green strip thickness so as to minimize deformation of the low expansion material i.e., nickel-iron phase. A particularly useful reduction is in the range of from about 25% to about 45% of the initial green strip thickness. The low expansion material particles in the rolled strip should have an aspect ratio as close as possible to unity.

A portion of the total reduction in green strip thickness can be accomplished with cold rolling. To do this, there must be an initial hot reduction of at least about 20%.

After hot rolling has been completed, the composite material may be quenched below about 500° C. in less than 30 seconds by directing cold furnace atmosphere gas onto the strip or by other commonly used quenching practices.

The finished composite strip material may then be fabricated into any desired final product. For example, it may be fabricated into lead frames, thermal spreaders in electronic packaging, engine cooling structures and devices for use in other thermal management applications.

It has been found that a composite material formed in accordance with the present invention provides improved through-thickness thermal conductivity and avoids problems associated with interdiffusion of the components.

The following examples are intended to demonstrate the process of the present invention.

EXAMPLE I

A blend of −400 mesh copper powder and −80 mesh +140 mesh INVAR (36% nickel, balance Fe) powder was made such that the volume percent of INVAR powder would be 60% in the fully densified material. Powders were blended with an addition of about 0.2% by weight of a 20% solution of glycerine in water.

A first portion of the powder was compacted in a hydraulic press to a thickness of 0.061". The resulting green strip was heated to 649° C. in 120 seconds by placing it in an oven and monitoring the temperature with a thermocouple. The material was then hot rolled in one pass to 0.038" and quenched. The thermal expansion coefficient was measured in a differential dilatometer using a fused silica standard as a reference material and was found to be $7.9\times10^{-6}$/° C. over the temperature range of 30° C. to 150° C.

A second portion of the powder was compacted to a green strip of 0.086" in thickness. The green strip was also heated to 649° C. in 120 seconds. The material was then hot rolled to 0.054" and quenched. The thermal conductivity of the material was measured in the through-thickness direction by measuring thermal diffusivity from which thermal conductivity can be calculated and was found to be 88 W/mK.

EXAMPLE II

A blend weighing 10 lbs. was made from 42.5 percent by weight of −200 mesh copper powder, 57.3 percent by weight of −200 mesh pre-alloyed 36 Ni-64 Fe powder and 0.2 percent by weight kerosene. This composition corresponded to 40 volume percent copper. The mixture was blended in a twin shell blender. The blended powder was then cold roll compacted to yield a strip 4 inches wide and 0.088 inches thick. A piece of this strip was then heated to 646° C. and immediately hot rolled to a thickness of 0.067 inches. This step was then repeated to yield a strip thickness of 0.047 inches. This strip in turn was cold rolled to a thickness of 0.028 inches.

Thermal expansion and electrical conductivity measurements were made on this strip and values are shown in Table 1. A sample of the strip was then given a series of annealing treatments, first at 450° C. for three minutes and then 760° C. for times up to a total of 165 seconds. After each anneal the electrical conductivity was remeasured. Values are shown in Table 1. The measured decrease in electrical conductivity reflects the loss of conductivity due to diffusion from the INVAR particles into the copper matrix. The thermal conductivity would be similarly affected by diffusion. These measurements illustrate that this composite material cannot be sintered at temperatures of 760° C. or higher without significant loss of conductivity. The high initial conductivity shows that the present process is effective. These results also illustrate that in the present method while heating to 650° C. and immediately hot rolling gives good results, over-heating to 760° C. for even a few seconds before hot rolling is harmful.

TABLE 1

| | |
|---|---|
| Coefficient of thermal expansion, $\times 10^{-6}$/°C. (30–150° C.) | 5.4 |
| Electrical conductivity, % IACS | 32 |
| Electrical conductivity after heat treatment, % IACS | |
| 450° C., 180 seconds | 33 |
| 760° C., 30 seconds | 28 |
| 760° C., 105 seconds | 24 |
| 760° C., 165 seconds | 22 |

EXAMPLE III

A blend of −80 mesh +140 mesh atomized 36% Ni−64% Fe powder and copper oxide was made using 261 gms. of NiFe powder and 106 gms. of copper oxide. An addition of 2% pine oil was made prior to blending. The blend was reduced in a hydrogen atmosphere at 555° C. for 75 minutes, and the resulting powder cake was crushed to produce a −80 mesh powder. An addition of elemental copper was made to this copper coated powder to adjust the composition to 35 volume percent copper, and this powder was blended with one percent of a 80:20 water-glycerine solution. The blend was cold roll compacted to yield a strip 4 inches wide and .073 inches thick. A piece was heated in a furnace set at 765° C. until its temperature reached 621° C., which took 56 seconds, and then it was immediately rolled to a thickness of 0.056". A second such rolling step reduced the strip thickness further to 0.045". The electrical conductivity was measured and found to be 24% IACS.

It is apparent that there has been provided in accordance with this invention a sinterless powder metallurgy process for manufacturing composite copper strip which fully satisfies the objects, means and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A process for forming an unsintered composite material, said process comprising:

compacting a blend of powdered copper matrix metal and powdered nickel-iron alloy material into a green strip of said composite material having an initial thickness;

heating said green strip to a hot rolling temperature in the range of from about 525° C. to about 1050° C. for a time period of less than about 2 minutes; and reducing the initial thickness of said heard green strip by less tan about 45% in order to minimize deformation of particles of said nickel-iron alloy material.

2. The process of claim 1 further comprising:

blending said powdered copper with a powdered nickel-iron alloy consisting essentially of from about 30 wt.% to about 60 wt.% nickel and the balance essentially iron prior to said compacting step.

3. The process of claim 2 wherein:

said blending step comprises blending from about 17 wt.% to about 69 wt.% copper having a particle size in the range of from about 10 μ to about 200 μ with from about 82 wt.% to about 31 wt.% of said nickel-iron alloy, said nickel-iron alloy consisting essentially of substantially spherical particles having a size in the range of from about 20 microns to about 200 microns.

4. The process of claim 1 wherein said heating step comprises:

passing said green strip through a furnace at a temperature in said range of from about 525° C. to about 1050° C. so that said green strip is exposed to a temperature not exceeding 700° C. for a time period of less than about 2 minutes.

5. The process of claim 1 wherein said heating step comprises:

passing said green strip through a furnace at a temperature in a range of from about 650° C. to about 900° C. so that said green strip is exposed to said elevated temperature for a time period in the range of from about 1.0 to about 10 seconds.

6. The process of claim 1 wherein said reducing state comprises hot working said heated strip so as to reduce said strip thickness from about 25% to about 45%.

7. The process of claim 1 wherein said reducing step comprises:

hot rolling said heated strip to initially reduce said thickness by at least about 20%; and cold rolling said strip to further reduce said strip thickness.

8. A process for forming a composite material having improved through-thickness thermal conductivity which comprises:

blending a powdered nickel-iron alloy having particles with an aspect ratio in the range of from about 1.0 to about 4.0 with an oxide of a desired matrix component in powder form;

heating said blended nickel-iron alloy and said oxide in a reducing atmosphere at a temperature in the range of from about 425° C. to about 625° C. for a time period in the range of from about 5 minutes to about 30 minutes so as to form a coating of said matrix component about individual particles of said nickel-iron alloy;

blending said coated nickel-iron alloy particles with said matrix component in powdered form; and forming said powdered coated particles and said powdered matrix component into a strip material having a substantially continuous path of said matrix component throughout the thickness of said strip.

9. The process of claim 8 wherein said nickel-iron alloy and matrix oxide blending step comprises:

blending from about 31 wt.% to about 83 wt.% of said nickel-iron alloy with from about 69 wt.% to about 17 wt.% cuprous oxide.

10. The process of claim 9 wherein said nickel-iron alloy and cuprous oxide blending step comprises blending a nickel-iron alloy consisting essentially of from about 30 wt.% to about 60 wt.% nickel and the balance essentially iron with said cuprous oxide.

11. The process of claim 9 wherein said nickel-iron alloy and cuprous oxide blending step comprises blending a nickel-iron alloy having particles with an aspect ratio in the range of from about 1.0 to about 2.0 and a particle size in the range of from about 50 microns to about 100 microns with cuprous oxide particles having a particle size in the range of from about 0.1 μ to about 10 μ.

12. The process of claim 8 wherein said forming step comprises:

compacting said blended nickel-iron alloy particles and matrix component particles into a green strip having a desired initial thickness; and heating said green strip to a temperature in the range of from about 525° C. to about 1050° C. for a time period of less than about 2 minutes.

13. The process of claim 12 wherein said forming step further comprises:

reducing said initial thickness of said strip by less than about 45% so as to minimize deformation of said nickel-iron alloy phase.

14. The process of claim 13 wherein said reducing step comprises:

hot rolling said strip material so as to take a reduction in strip thickness of at least about 20%; and cold rolling said strip material so as to further reduce its thickness.

15. A process for forming an unsintered composite material having improved through-thickness conductivity, said process comprising:

blending powdered copper with a powdered nickel-iron alloy consisting essentially of from about 30 wt.% to about 60 wt.% nickel and the balance essentially iron;

compacting said blended copper and nickel-iron alloy powders into a green strip of said composite material having an initial thickness;

heating said green strip by passing said green strip through a furnace at a temperature in the range of from about 525° C. to about 1050° C. so that said strip is exposed to a temperature not exceeding 700° C. for a time period of less than about 2 minutes; and reducing the initial thickness of said strip by at least about 20% by hot rolling said strip as said strip leaves said furnace.

16. A process for forming an unsintered composite material having improved through-thickness conductivity which comprises:

providing a low thermal expansion metal material in powdered form;

coating said powdered low thermal expansion metal material with a desired matrix material;

said coating step comprising blending said powdered low thermal expansion material with an oxide of said matrix material and forming said coating by heating said blended materials in a reducing atmosphere;

blending said coated low thermal expansion material with said matrix material in powdered form;

compacting said blend into a green strip of said composite material having an initial thickness;

heating said green strip by passing said green strip through a furnace at a temperature in the range of from about 525° C. to about 1050° C.; and reducing the initial thickness of the heated green strip by less than about 45% without sintering in order to minimize deformation of the particles of the low thermal expansion material, whereby said composite material substantially avoids problems associated with interdiffusion between said powered material.

* * * * *

UNITED STATES PATENT AND TRADEMARK OFFICE

CERTIFICATE OF CORRECTION

PATENT NO. : 5,152,959

DATED : OCTOBER 6, 1992

INVENTOR(S) : CLIVE R. SCOREY

It is certified that error appears in the above-identified patent and that said Letters Patent is hereby corrected as shown below:

COLUMN 6, CLAIM 1, LINE 67, "HEARD" SHOULD READ --HEATED--

COLUMN 6, CLAIM 1, LINE 68, "TAN" SHOULD READ --THAN--.

COLUMN 7, CLAIM 3, LINE 13, "82 WT.%" SHOULD READ --83 WT.%--.

COLUMN 7, CLAIM 6, LINE 32, "STATE" SHOULD READ --STEP--.

Signed and Sealed this

Twenty-first Day of September, 1993

Bruce Lehman

*Attest:*

BRUCE LEHMAN

*Attesting Officer*

*Commissioner of Patents and Trademarks*